US007035421B2

(12) United States Patent
Ma

(10) Patent No.: US 7,035,421 B2
(45) Date of Patent: Apr. 25, 2006

(54) EARPHONE SET

(76) Inventor: Hsi Kuang Ma, 4F, No. 48, Sec. 2, Chung Cherng Road, Taipei (TW)

( * ) Notice: Subject to any disclaimer, the term of this patent is extended or adjusted under 35 U.S.C. 154(b) by 0 days.

(21) Appl. No.: 10/308,745

(22) Filed: Dec. 3, 2002

(65) Prior Publication Data

US 2003/0103640 A1 Jun. 5, 2003

(30) Foreign Application Priority Data

Dec. 5, 2001 (TW) ..... 90221182 U

(51) Int. Cl.
*H04R 25/00* (2006.01)

(52) U.S. Cl. ..... 381/372; 381/374; 381/378

(58) Field of Classification Search ..... 381/370, 381/378, 380, 373, 374, 375, 377, 379, 182, 381/372; 379/428, 430; 455/66.1, 100
See application file for complete search history.

(56) References Cited

U.S. PATENT DOCUMENTS

| | | | | | |
|---|---|---|---|---|---|
| 220,839 | A | * | 10/1879 | Hubbard | 381/370 |
| 2,337,953 | A | * | 12/1943 | Wirsching | 381/372 |
| 2,586,644 | A | * | 2/1952 | Gilbert | 381/382 |
| 4,058,688 | A | * | 11/1977 | Nishimura et al. | 381/372 |
| 6,483,925 | B1 | * | 11/2002 | Shen et al. | 381/370 |
| 6,707,924 | B1 | * | 3/2004 | Okiebisu | 381/385 |

FOREIGN PATENT DOCUMENTS

JP 53023601 A * 3/1978

* cited by examiner

*Primary Examiner*—Sinh Tran
*Assistant Examiner*—Phylesha L Dabney

(57) ABSTRACT

An earphone set includes two earphones and a connecting device. Each of the earphones has a sound output device respectively. The connecting device is connected to the two earphones. It is characterized in that the two earphones output sound signals in the same direction.

12 Claims, 3 Drawing Sheets

EARPHONE SET

BACKGROUND OF THE INVENTION

1. Field of the Invention

The present invention relates to an earphone set and particularly to an improved earphone set, with which it is possible for the user to be free from ear pain resulting from sound outputs being sent out in different directions.

2. Description of Related Art

It is known that the earphone set is frequently used in our daily lives due to the earphone set having a function of sending out sound signals so that it is popularly adopted to listen to a stereo, a WALKMAN or a radio.

The conventional earphone set as shown in FIG. 1 has two opposite earphones corresponding to the ears. A headband may connect the two earphones regardless it is shield type or plug type. Of course, there are plug type earphone sets with separate earphones in addition to the connected earphones . In fact, sound signal is output via speakers in the two earphones to generate vibrations to impact eardrums so that the impact can be delivered to our brain for sensing the vibrations.

Usually, theses two speakers are directed inward, i.e., the speakers face against insides of the ears such that the sound signal outputs strike the eardrums directly. Alternatively, the speakers are arranged to face outward instead of facing inward. Anyway, the conventional sound signal output devices are disposed either to be face to face or back to back basically.

We all know that the ear structure has an eardrum at the outer side thereof and a helicotrema at the inner side thereof. Hence, the helicotrema communicates with the oral cavity to constitute a closed space. Thus, once the earphones at both ears send out sound signals to strike the eardrums sharply, pressures in the right and the left ears transmit to the closed space between the respective helicotrema and the oral cavity so that the eardrums are unable to vibrate easily and the sound is unclearly heard. Under this circumstance, it may cause ear pain and it is believed that the user of the earphone set has experienced this kind of ear pain before. Similarly, the eardrums become pulled outward to cause ear pains in case of the earphones at both ears facing outward. Therefore, it is natural that time for the wearer to wear the earphone set is reduced and the chance to use the earphone set is less accordingly.

SUMMARY OF THE INVENTION

The crux of the present invention is to provide an earphone set, which includes two earphones and a connecting device. Each of the earphones has a sound output device respectively. The connecting device is connected to the two earphones. It is characterized in that the two earphones output sound signals in the same direction so that the ear pain as the preceding description can be relieved substantially.

In an embodiment of the invention, an earphone set comprising two earphones and a connecting device connected to the two earphones Is provided. Each of the earphones has a sound output device. The two earphones are configured to be arranged on the ears of a user such that the sound signals are outputted therefrom in substantially the same direction as defined by and along an axis between the eardrums of the user. One sound output device outputs sound into a first ear of the user while the other sound output device outputs sound away from a second ear of the user.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
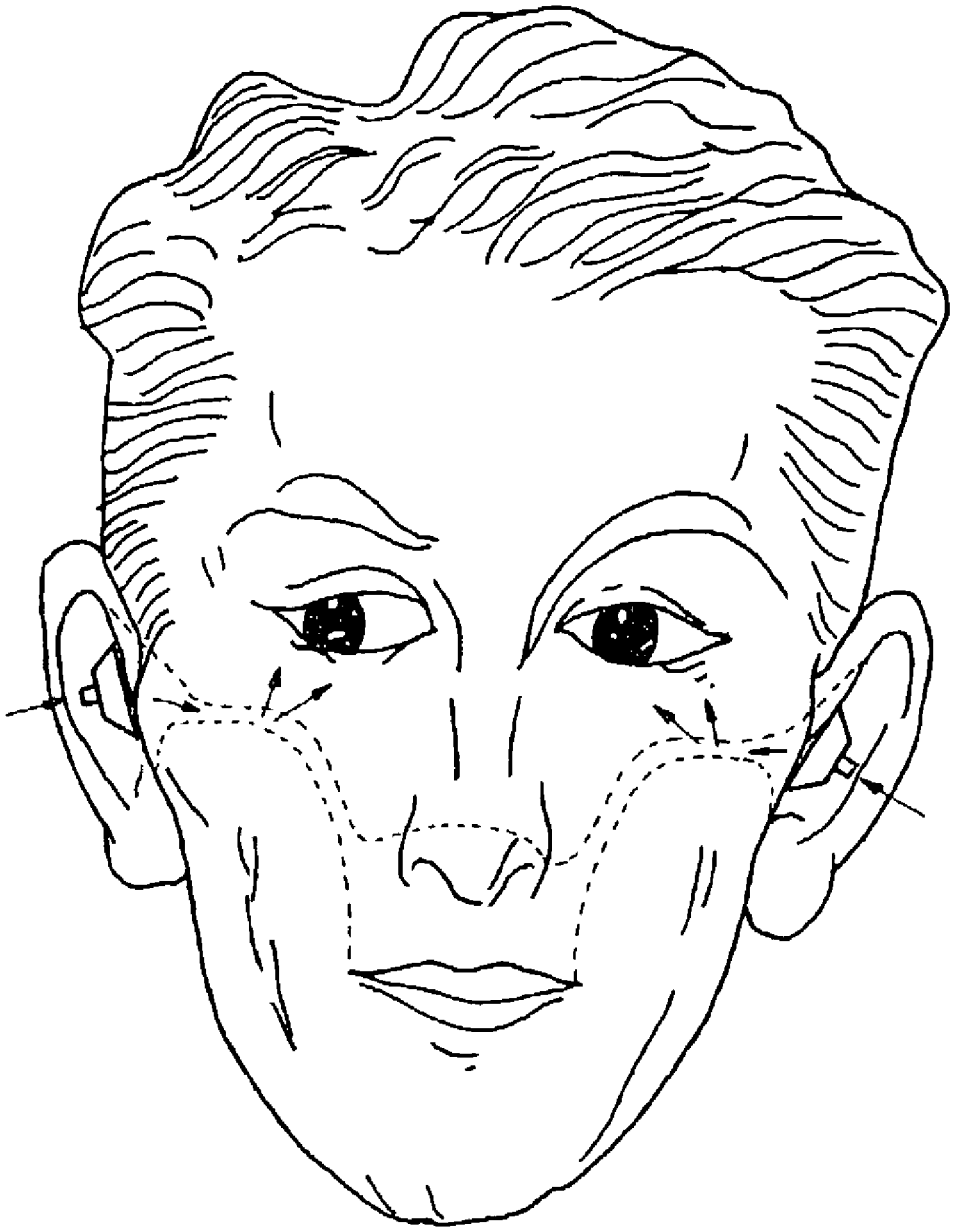
(PRIOR ART) FIG. 1
FIG. 1 is a plan view of a conventional earphone set.
Figure 2:
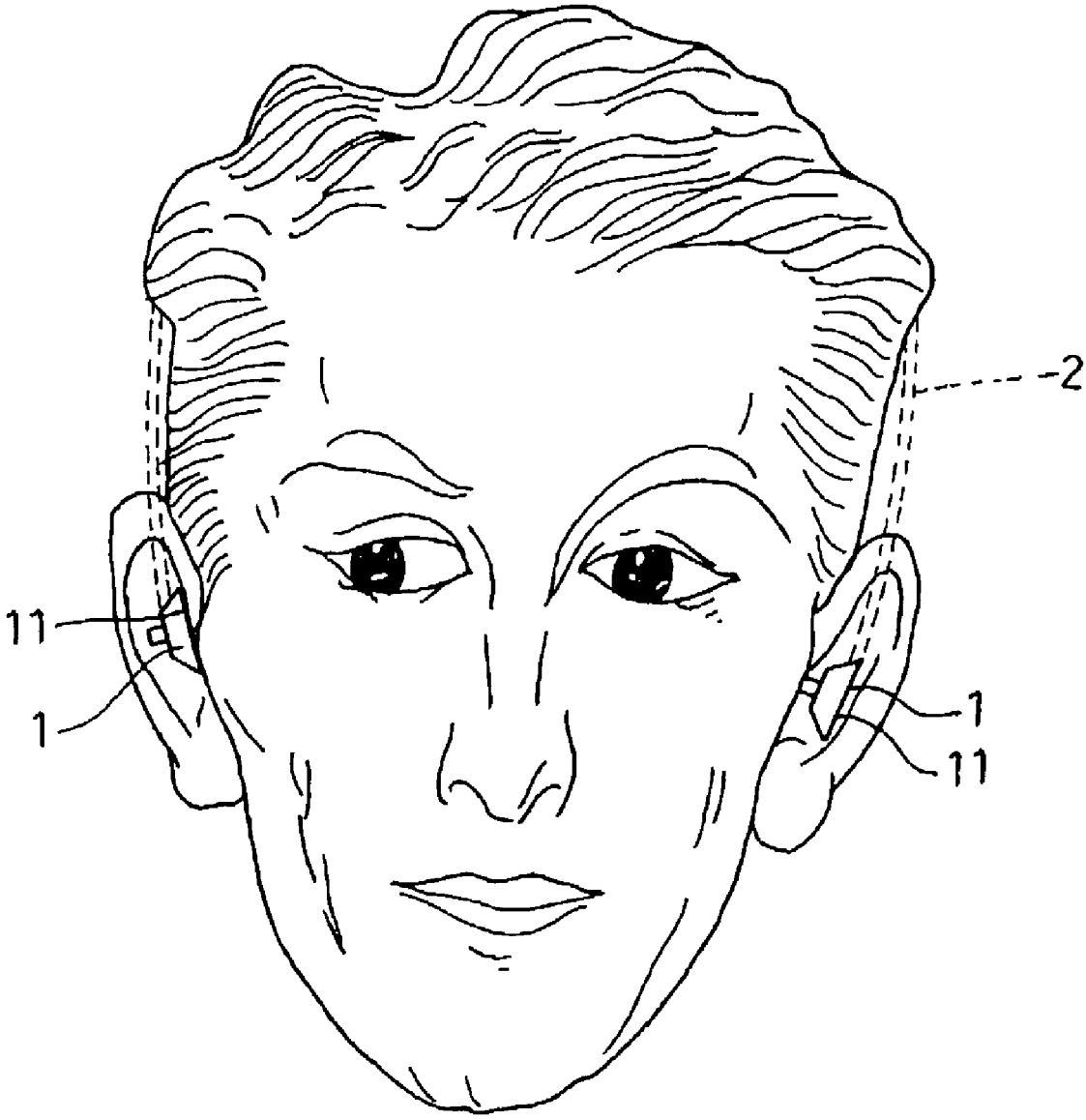
FIG. 2 is a plan view of an earphone set according to the present invention.
Figure 3:
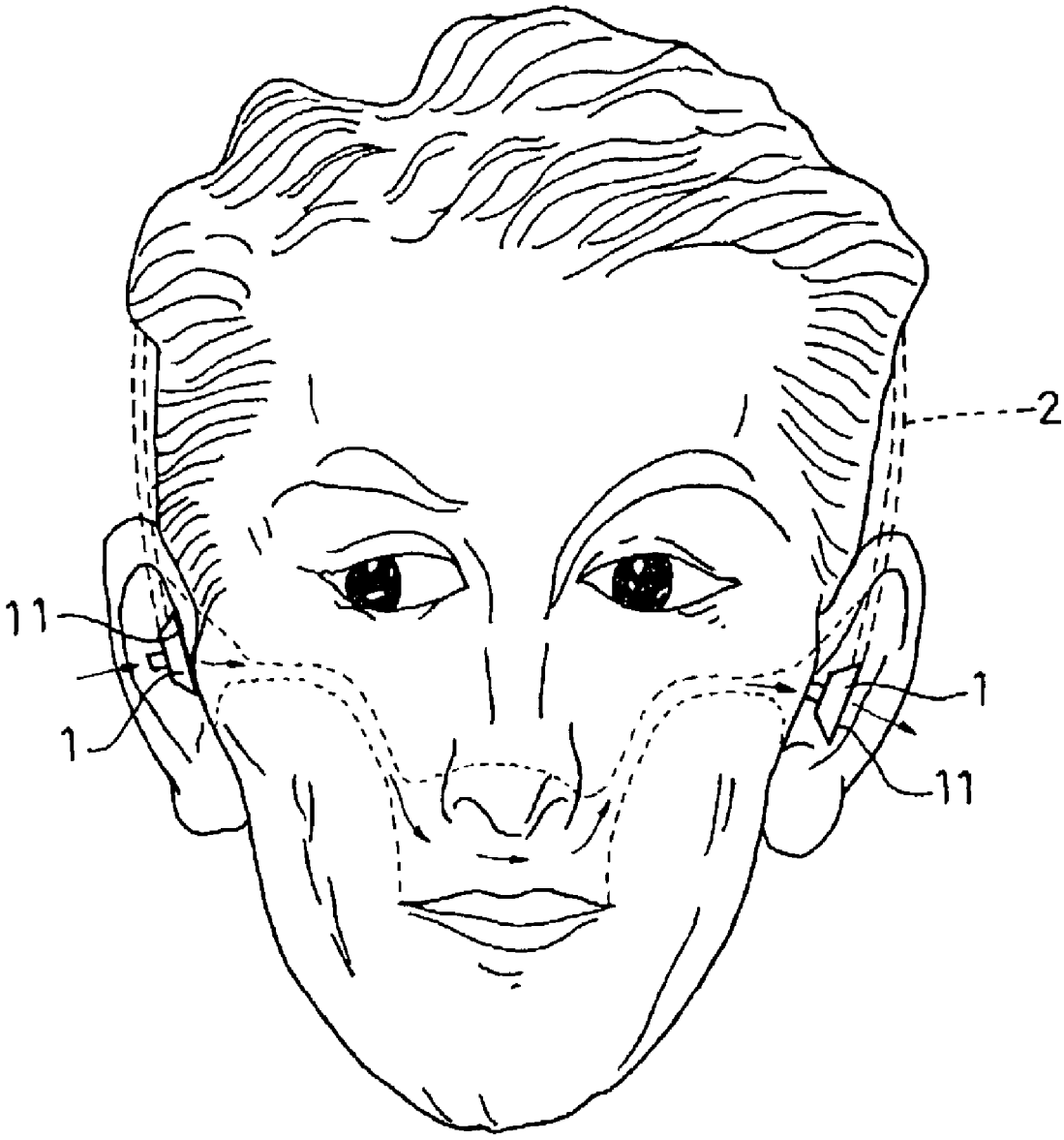
FIG. 3 is a plan view illustrating a moving direction of the vibrating wave while the earphone is in use.

Referring to FIGS. 2 and 3, an earphone set according to the present invention is basically comprised of an earphone body 1, which includes a left earphone and a right earphone, and a connecting device 2.

Wherein, the earphone body 1 can be a shield type or a plug type with a sound input part. The interior of the earphone body 1 has a sound signal output device 11, which is a speaker. In order to eliminate a feeling of pain, the earphone set of the present invention is characterized in that the respective output device 11 in the left and the right earphones are arranged in the same direction. That is, if the output device 11 in the right earphone faces to the right direction, the output device 11 in the left earphone faces to the right too and vice versa. In this way, the sound signals can move in the same direction to enhance the clearness of the sound out in addition to removing the ear pain.

The connecting device 2 is a conventional device and the purpose thereof is to avoid the two earphones of the earphone body becoming separate and feasible for being put on so that it is possible for the connecting device 2 to be made with a soft band, a hard band or the like.

Referring to FIGS. 2 and 3 again, while in use, both the sound signal output devices 11 send out the sound outputs in the same direction so that the vibrating waves can transmit to the eardrum in one of the ears and then to the eardrum of the other ear via the helicotrema of the first ear and the oral cavity to constitute a vibrating wave route. Hence, it is capable of eliminating the pain resulting from the conventional earphone set and enhancing the clearness of sound output.

Meanwhile, both of the sound signal outputs 11 in the earphone body 1 output the sound signals synchronously so that the vibrating waves move along the same direction to form a vibrating wave route as mentioned above. Therefore, it is possible to relieve the pain caused by the inward strike or the outward pull, which usually results from the conventional earphone set due to sound signals not being sent out in the same direction.

In order to have the sound signals being output in the same direction, the speaker in the respective sound output device 11 can be designed to meet the purpose in addition to the sound output devices 11 being arranged in the same direction. Basically, the speaker has a vibration membrane with a voice coil. The voice coil is made of curled fine copper wire or metal wire with a positive pole at an end thereof and a negative pole at another end thereof. The sound frequency signal can generate a magnetic field after passing through the positive and the negative poles and the magnetic field divides the magnetism to vibrate the sound signal. Hence, the sound signal outputs can move along the same direction as well in case of the speaker in one of the sound output devices is arranged to exchange the positive and the negative poles thereof. In this way, it is not necessary for the speakers in both of the sound output devices are disposed inversely.

As the foregoing, it is appreciated that a great advantage of the earphone set according to the present invention substantially solves a problem, which has been pended for a long time.

While the invention has been described with reference to the a preferred embodiment thereof, it is to be understood that modifications or variations may be easily made without departing from the spirit of this invention, which is defined by the appended claims.

What is claimed is:

1. An earphone set, comprising:

two earphones, each of the earphones having a sound output device respectively; and a connecting device, being connected to the two earphones; characterized in that the two earphones are configured to be arranged on the ears of a user such that the sound output devices are disposed on an axis between the ears of the user and output sound signals in substantially the same direction and along the axis.

2. The earphone set as defined in claim 1, wherein the sound output device is a speaker.

3. The earphone set as defined in claim 1, wherein the connecting device has a shape of band.

4. The earphone set as defined in claim 1, wherein connecting device has a coil shape.

5. The earphone set as defined in claim 1, wherein each of the earphones is shield type.

6. The earphone set as defined in claim 1, wherein each of the earphones is plug type.

7. The earphone set as defined in claim 1, wherein both the sound output devices are arranged toward a right side.

8. The earphone set as defined in claim 1, wherein both the sound output devices are arranged toward a left side.

9. An earphone set, comprising:

a first earphone having a first sound output device;

a second earphone having a second sound output device; and a connecting device connected between the first and second earphones;

wherein the earphones are configured such that the first and second sound output devices are arranged on the ears of a user such that the first sound output device outputs sound into a first ear of the user and the second sound output device outputs sound away from a second ear of the user.

10. The earphone set as claimed in claim 9, wherein the first and second sound output devices are configured to be arranged on the user so as to output sound in substantially the same direction as defined by an axis between the eardrums of the user.

11. The earphone set as defined in claim 9, wherein each of the first and second earphones is shield type.

12. The earphone set as defined in claim 9, wherein each of the first and second earphones is plug type.

* * * * *